US007348040B2

(12) United States Patent
Kleinerüsskamp et al.

(10) Patent No.: US 7,348,040 B2
(45) Date of Patent: Mar. 25, 2008

(54) METHOD FOR IMPROVING CHARACTERISTICS OF RESIN COATED PAPERS COMPRISING APPLYING A SOLUTION OF ONE OR MORE ALKALINE METAL SALTS

(75) Inventors: Heinz Kleinerüsskamp, Arnsberg (DE); Kimmo Suur-Nuuja, Arnsberg (DE)

(73) Assignee: OKT Kunststofftechnik GmbH, Sternwede-Oppenwehe (DE)

( * ) Notice: Subject to any disclaimer, the term of this patent is extended or adjusted under 35 U.S.C. 154(b) by 0 days.

(21) Appl. No.: 10/512,036

(22) PCT Filed: Apr. 24, 2003

(86) PCT No.: PCT/EP03/04247

§ 371 (c)(1),
(2), (4) Date: Jun. 22, 2005

(87) PCT Pub. No.: WO03/091470

PCT Pub. Date: Nov. 6, 2003

(65) Prior Publication Data

US 2006/0008586 A1 Jan. 12, 2006

(30) Foreign Application Priority Data

Apr. 26, 2002 (EP) ..... 02009270

(51) Int. Cl.

| | |
|---|---|
| ***B05D 3/10*** | (2006.01) |
| ***B05D 1/34*** | (2006.01) |
| ***B05D 1/36*** | (2006.01) |
| ***B05D 1/38*** | (2006.01) |

(52) U.S. Cl. ..... 427/342; 427/288; 427/341; 427/391; 427/428.06

(58) Field of Classification Search ..... 427/411
See application file for complete search history.

(56) References Cited

U.S. PATENT DOCUMENTS

| | | | | |
|---|---|---|---|---|
| 3,730,828 | A | | 5/1973 | Meiser |
| 4,376,106 | A | * | 3/1983 | Miyanohara et al. ..... 423/710 |
| 4,396,544 | A | | 8/1983 | Dore |
| 5,006,451 | A | * | 4/1991 | Anderson et al. ..... 430/527 |
| 5,421,960 | A | | 6/1995 | Canary |

FOREIGN PATENT DOCUMENTS

| | | | |
|---|---|---|---|
| DE | 25 37 409 | | 3/1977 |
| DE | 2658784 | A | 7/1978 |
| EP | 601243 | A1 | 6/1994 |
| GB | 1576140 | | 10/1980 |
| SU | 1052601 | A1 | 11/1983 |
| SU | 1168098 | A1 | 7/1985 |

OTHER PUBLICATIONS

Lewis, Richard J., Sr. (2002). Hawley's Condensed Chemical Dictionary (14th Edition). John Wiley & Sons. Definitions of "demineralization" and "deionizing."*

* cited by examiner

*Primary Examiner*—William Phillip Fletcher, III
(74) *Attorney, Agent, or Firm*—Wood, Phillips, Katz, Clark & Mortimer

(57) ABSTRACT

For treating resin coated decorative papers. a solution of sodium aluminate in deionized water is applied, during printing with metal effect inks by gravure printing by a fond or subcoat cylinder. The solution has a pH-value between pH 9 and pH 14.

15 Claims, No Drawings

METHOD FOR IMPROVING CHARACTERISTICS OF RESIN COATED PAPERS COMPRISING APPLYING A SOLUTION OF ONE OR MORE ALKALINE METAL SALTS

The present invention relates to methods for improving metal effects and criteria for further processing as well as the flexibility of resin coated decorative papers. Printed decorative papers are used in the coating industry for coating laminates or are directly applied on wood substitute boards for surface improvement and decoration. Further processing is done by means of impregnation with melamine resins, phenol resins, urea resins and other mixed resin systems and further resin solutions as well as by means of lacquering with chemically or physically hardening lacquer systems. After printing and impregnating, a resin coated decorative film is produced as a next intermediate product and as pre-product for pressing in a short cycle method on chip boards and other wood materials (LPM method), for pressing with further phenol resin impregnated and other resin impregnated papers in a high-pressure method to produce decorative laminated materials (HPL method) as well as in a continuous pressing method (CPL method).

As materials for the carriers of the printed image and for the resin, extremely resin saturating impregnatable decorative papers having a weight per unit area of 45 $g/m^2$ to 200 $g/m^2$, preferably 70 $g/m^2$ to 90 $g/m^2$, are used. As decorative print water based inks, i. e. without organic solvents or with reduced solvent content having exclusively organic pigments and binder systems on casein basis as well as topsealers for pearl-prints on polyurethane basis are used. Commercial water based RWO decorative inks are known e. g. under the trade names Hartmann/761-series or Arcolor 1010/1012/3008/3017/5000/7000 and others. Metal effect inks or inks resulting in an irisation (colour change) are sold under the name Hartmann T 1332/761, T 2630/761, Arcolor Ardeco Brilliant Silver, Ardeco Brilliant Pearl inks.

As discussed above, the first group of inks (Hartman/761-series or Arcolor 1010/1012/3008/3017/5000/7000) can be characterized as "water-based decor inks with organic pigments." Moreover, the second group of pigments (Hartmen T 1332.761, T 2630/761, Arcolor Brilliant Silver, Arcolor Brilliant Pearl) can be characterized as "metal-effect inks pigmented with titanium dioxide-coated silicon dioxide."

There are several problems. In further processing, deformability of the impregnated decorative films is especially relevant. Rounded edges of coated wood materials are achieved by drawing-around of high-pressure laminates (HPL), by mechanically/thermally producable edges. This method is called post-forming. Conventionally produced standard base papers can not or not sufficiently be post-formed around narrow radii if they are used as High-Pressure Laminates (HPL), e. g. in the production of work boards or furniture front boards with rounded edges. Presently, very expensive and specially produced base papers, so-called post-forming papers, are used for this purpose as state of the art. The laminated boards themselves have, at the critically narrow radii on the side opposing the coating, indentations or milled structures as known e. g. from DE 198 30 778 C1. The paper layer applied at the outer border of the arc is substantially stretched thereby, however.

The minimal radius with which a decorative film can be drawn around a wood material edge without detrimenting the press results can be determined by the disc cure value. The higher the disc cure value the slower is the reactivity of the compound of decorative paper resin and the "softer" is the paper in further processing.

Thus, it is an object of the invention to adapt conventional standard base papers to respective client needs also in this market segment.

The optical and physical properties as well as the achievable metal effect of the readily coated material are further important quality criteria. The maximum optical effects are achieved by applying the highest possible ink quantities during decorative printing. Therefore, fond cylinders having the largest possible theoretical ink transfer volume are used. The maximum possible ink transfer is limited by the drying capacity of the printing press.

Higher pigment concentration in the metal effect ink substantially increases the risk of print defects as stripes, deposition of ink pigments and others. A too low extender (binding varnish) quantity reduces the fixing of the pigments on the decorative paper and causes a bleeding of the decorative print during impregnating leading to an out-washing of substantial quantities of metal effect pigments in the resin basin. Further, a too low extender quantity reduces the abrasion resistance of the non-resin coated and printed decorative paper rolls. Thus, during the run of the printed paper through the impregnation bath at the directing rolls, it is hardly possible not to damage the printed image. The possibilities to achieve higher metal effects by increasing the ink deposition are thus limited because the following problems may occur: Inhomogeneous dark and stained surfaces, eventually "pearl-effect lowering". By means of an increased metallic ink deposition, no improved pearl or metallic effects can be achieved.

It is thus a further object of the invention, to improve the gloss degree and the metallic effects on the printed surface as well as the quality of the coated surface by reduction of visible press failures.

The general solution according to the invention is to apply by means of gravure printing a solution of alkaline (i. e. basic) metal salts delaying the resin hardening. Thereby cost-effective standard base papers can be used in improving the post-forming properties and a costly chemical pretreatment of special papers is obsolete. Metal salts in the alkaline region are used for improving the post-forming properties. Moreover, in this way an improvement of the gloss degree and the metal effects as well as a reduction of press failures, as mentioned above, is achieved. Further features, details and embodiments can be taken from the dependent claims.

As explained above, normally produced standard base papers can not or not sufficiently be post-formed around narrow radii as high-pressure laminated materials (HPL).

In contrast thereto, according to an embodiment of the invention, by applying a sodium aluminate solution (water or water/extender mixture) by gravure printing with fond cylinders or another adequate method on the printed or not-printed standard base paper, the hardening speed of the impregnated material (base paper/resin) is reduced and thus the desired effect of post-formability is caused. Hereto, sodium aluminate ($=NaAlO_2 \times 0.12Na_2O \times 0.3H_2O$) is solved. This is done in several steps:

- Sodium aluminate→this chemical is solved in >60° C. hot demineralised water (or water in general) in order to produce the mixture in the desired concentration;
- solid contents of 0.5 up to maximum 5% in relation to the complete ready for print preparation;
- pH-value→depending on the requirements to be adjusted between pH 9 and 14;

applying the ready solution onto the paper with a fond cylinder by gravure printing. This in dependency from fond volume and machine speed. Orientation values or target value minimum 3 g/m$^2$ up to maximum 25 g/m$^2$ wet;

test method of the hardening rate with the "Disc Cure Test" method as usual in this technical field.

For the object to print the above mentioned commercial metal effect inks on standard decorative paper as a full area or in combination with wood, stone or graphical decorations, preferably the subcoat of homogeneous colours on decorative papers with weights per unit area between 70 g/m$^2$ and 90 g/m$^2$, it shall be printed as a rotation gravure print continuously from roll to roll. As an alternative, also two-dimensional coating methods as flexoprinting, hachure printing or similar methods shall be possible. The transfer of two-dimensional ink quantities shall be done wet with a high ink transfer on printed or non-printed decorative papers. The ink transfer in rotation gravure printing shall be done with a fond cylinder.

Decorative gravure printing presses having a print width up to 2.750 mm with conventional gravure press units and hot air dryers shall be used. The gravure printing fond cylinders are electromechanically engraved, laser engraved or etched. Prior art are fond cylinders having a ceramic surface in which the small cells are burned-in by laser technique. As an alternative, cylinders can be used having a conventionally electromechanically engraved copper surface which is subsequently protected against mechanical damages by a chromium layer.

In a gravure press unit of a decorative gravure printing press, printing is performed with a printing cylinder having a homogeneously engraved matrix field being designated as a "fond cylinder" herein. Ink transfer onto the fond cylinder is done from stock containers by electrical pumps or pneumatic membrane pumps. The metal effect ink is continuously stirred to inhibit sedimentation and is circulated by the pumps. From the stock containers, the ink is supplied into the ink pan below the fond cylinders into the press unit of the decorative gravure printing press. The application of the metal effect ink is by inking rollers coated with a lasered and easily compressible rubber coating. Thereby the ink is taken from the ink pan and applied onto the print cylinder. Alternatively, the fond cylinder is immersed into the ink contained in the ink pan and receives an ink film on the surface and in the cells. The fond cylinder is wiped by a doctor blade in rotation direction, which takes off superfluous metal effect ink from the cylinder surface and leaves only a defined ink quantity in the so-called cells. Further in rotation direction, the cylinder arrives in the printing zone. Here, the paper being supplied by drives and guiding rolls in the printing zone of the press unit is pressed onto the cylinder by a roll applied by mechanical pressure. The force with which this roll called "impression roller" presses on the paper is usually around 18 N/cm, depending on the individual application also a higher force is possible. By means of the pressure as well as centrifugal, cohesion and capillary forces, the ink is transferred from the cell onto and into the paper. Behind the printing zone, the printed wet paper is supplied to the hot air dryer of the press by guiding rolls, where water used as ink solvent is expelled by hot air having temperatures up to 150° C. and air velocities up to 50 m/sec. In order to produce a colour area with a metal effect on the finished product, metal effect inks such as the above mentioned pearl ink are used. The homogeneity after printing and after further processing as well as the achievable colour intensity are relevant quality criteria. Due to high binder and pigment application, the porous surface of the decorative paper is closed such that the resin penetration is reduced and substantially slowed down. Consequently, the achievable impregnation speeds are substantially reduced deteriorating the economical efficiency of the impregnation. The fixing of the metal effect pigments is more difficult than with conventional decorative inks so that either special binder systems are used in the metal effect ink as well as in the additionally required extender/binder. Alternatively, an additional fond is printed exclusively with extender on the metal effect ink to better fix the metal effect pigments. For enhancing the gloss degree and the metal effects on the printed surface, a printing of multiple layers of metal effect inks by a repetition of the printing process in further press units is possible. The precise adjustment of the colouration compared to reference samples is hardly possible, though, since substantial and hardly controllable changes of the colouration result therefrom. Further, by each further printing process, the paper surfaces close more and more reducing the porousity of the decorative paper and thus the impregnatability. Consequently, the speed of the impregnation process must be reduced. When using effect inks (pearl, silver and irisating inks) in higher concentrations (>5%) on the respective printed decorative papers, problems on the finished product can become visible as mentioned above (finished products=HPL elements/LPM elements). However, according to the invention, for effect inks (pearl, silver and irisating inks) in higher concentrations (>5%), a sodium aluminate solution (water or water/extender mixture) can be applied onto the respective printed decorative papers by gravure printing with fond on the surface of the metallic print.

A "fond cylinder," as discussed herein, may be alternatively called a "subcoat cylinder."

According to a further embodiment of the invention, a sodium aluminate solution (water or water/extender mixture) is applied onto the surface of the metallic print by gravure printing by means of a fond cylinder. Thereby, a substantially increased pearl or metallic effect with simultaneous improvement of the surface homogeneity HPL/LPM can be achieved.

Therein, the following steps are conducted:

Sodium aluminate→this chemical is solved in >60° C. hot demineralised water (or water in general) in order to produce the mixture in the desired concentration;

solid contents 0.5 up to maximum 5% related to the complete ready-for-print preparation (water or water/extender);

pH-value→to be adjusted between pH 9 and 14 depending on the requirements;

application of the ready solution onto the paper by means of a fond cylinder and gravure printing, this depending from the fond volume and the machine speed. Orientation values or target values are minimum 3 g/m$^2$ up to maximum 25 g/m$^2$ wet.

Pearl pigments are compounds in the form of feldspar or silicic acid (silicon dioxide) coated by titanium dioxide.

Titanium dioxide acts as a catalysts (accelerates hardening of amino plastic resins); thus, an adequately adjusted topcoat as a positive effect on the hardening (resin flow) with simultaneous improvement of the pearl effect. Appropriate amino plastic resins are e.g:

melamine-formaldehyde resins urea-formaldehyde resins.

The invention claimed is:

1. A method for treating resin coated decorative papers, wherein a solution of one or more alkaline metal salts delaying hardening of the resin is applied, during printing with metal effect inks.

2. The method according to claim 1, wherein the alkaline metal salt solution is a sodium aluminate solution in water or in a water/extender mixture.

3. The method according to claim 2, wherein sodium aluminate is dissolved in >60° C. hot water, in order to produce the mixture.

4. The method according to claim 3, wherein the water is demineralized water.

5. The method according to claim 1, wherein the alkaline metal salt is sodium aluminate and has a proportion of 0.5 up to maximum 5 weight-% related to the solution.

6. The method according to claim 1, wherein the alkaline metal salt is sodium aluminate and wherein a sodium aluminate solution having a pH-value between pH 9 and 14 is used.

7. The method according to claim 1, wherein the alkaline metal salt is sodium aluminate and is applied in a ready solution onto the paper by means of a subcoat cylinder and gravure printing.

8. The method according to claim 7, wherein an orientation value or a target value of minimum 3 $g/m^2$ up to maximum 25 $g/m^2$ wet is observed.

9. The method according to claim 1, wherein the alkaline metal salt is sodium aluminate and wherein for effect inks selected from the group consisting of pearl, silver, and irisation inks, a sodium aluminate solution in water or in a water/extender mixture is applied onto the surface of the metallic prints by means of gravure printing with a subcoat cylinder.

10. The method according to claim 9, wherein the sodium aluminate is dissolved in >60° C. hot water, in order to produce the mixture.

11. The method according to claim 9, wherein the sodium aluminate has a solid contents of 0.5 up to maximum 5% related to the solution.

12. The method according to claim 9, wherein a sodium aluminate solution having a pH-value between pH 9 and pH 14 is used.

13. The method according to claim 9, wherein the sodium aluminate in the ready solution is applied onto the paper by means of a subcoat cylinder and gravure printing.

14. The method according to claim 13, wherein an orientation value or a target value of minimum 3 $g/m^2$ up to maximum 25 $g/m^2$ wet is observed.

15. The method according to claim 1, wherein the alkaline metal salt solution is applied in a gravure printing method by a subcoat cylinder.

* * * * *